US009453167B2

(12) United States Patent
Zink

(10) Patent No.: US 9,453,167 B2
(45) Date of Patent: Sep. 27, 2016

(54) METHODS AND APPARATUSES FOR PROCESSING HYDROCARBON STREAMS CONTAINING ORGANIC NITROGEN SPECIES

(71) Applicant: UOP LLC, Des Plaines, IL (US)

(72) Inventor: Steven F. Zink, Westmont, IL (US)

(73) Assignee: UOP LLC, Des Plaines, IL (US)

( * ) Notice: Subject to any disclaimer, the term of this patent is extended or adjusted under 35 U.S.C. 154(b) by 256 days.

(21) Appl. No.: 14/015,657

(22) Filed: Aug. 30, 2013

(65) Prior Publication Data

US 2015/0060334 A1 Mar. 5, 2015

(51) Int. Cl.
*C10G 17/04* (2006.01)
*C10G 67/08* (2006.01)

(52) U.S. Cl.
CPC ..... *C10G 17/04* (2013.01); *C10G 67/08* (2013.01)

(58) Field of Classification Search
CPC ..... C10G 3/48; C10G 3/50; C10G 75/02
See application file for complete search history.

(56) References Cited

U.S. PATENT DOCUMENTS 2,437,544 A * 3/1948 Marisic ..... C07C 2/62 585/715
2,518,353 A 8/1950 McKinnis
2,848,375 A 8/1958 Gatsis
2,917,364 A 12/1959 Stanley
3,607,136 A 9/1971 Smiley et al.
3,719,587 A 3/1973 Karchmer et al.
4,258,010 A * 3/1981 Rozsa ..... B01D 11/0449 422/257
4,392,948 A 7/1983 Debande
4,960,508 A * 10/1990 Evans ..... C10G 17/04 208/254 R
5,053,579 A 10/1991 Beech, Jr. et al.
5,770,047 A * 6/1998 Salazar ..... B01J 29/0061 208/208 R
5,938,328 A * 8/1999 Pinto ..... B01F 5/0451 366/174.1
6,390,114 B1 * 5/2002 Haandrikman .... B01D 19/0063 137/187
6,599,417 B2 7/2003 Pradhan et al.
6,736,963 B2 5/2004 Pradhan et al.
7,153,414 B2 12/2006 De Souza
7,175,755 B2 2/2007 de Souza
7,288,181 B2 10/2007 Shih et al.
7,357,856 B2 * 4/2008 Jacobs ..... C10G 45/08 208/143

(Continued)

FOREIGN PATENT DOCUMENTS

WO 2008016401 A1 2/2008
WO 2010127752 A1 11/2010

OTHER PUBLICATIONS

Search Report dated Nov. 24, 2014 for corresponding PCT Appl. No. PCT/US2014/050875.

(Continued)

*Primary Examiner* — Randy Boyer
*Assistant Examiner* — Juan Valencia

(57) ABSTRACT

Methods and apparatuses for processing hydrocarbon streams containing organic nitrogen species are provided. In an embodiment, a method for processing a hydrocarbon stream containing organic nitrogen species includes adding an aqueous acidic solution to a hydrocarbon feed stream to form a reaction stream. The method further includes contacting the reaction stream with a reaction surface and reacting the aqueous acidic solution and the organic nitrogen species to form an ammonium sulfate rich stream and a lean nitrogen naphtha stream. Also, the method includes separating an ammonium sulfate rich aqueous phase and an oil phase from the ammonium sulfate rich stream.

17 Claims, 3 Drawing Sheets

(56) References Cited

U.S. PATENT DOCUMENTS

| | | | | |
|---|---|---|---|---|
| 7,473,351 | B2 | 1/2009 | Burnett et al. | |
| 2004/0178123 | A1* | 9/2004 | Podrebarac | C10G 67/06 208/211 |
| 2005/0023191 | A1 | 2/2005 | Shih et al. | |
| 2006/0081502 | A1 | 4/2006 | Burnett et al. | |
| 2008/0033227 | A1 | 2/2008 | Graves | |
| 2008/0035530 | A1* | 2/2008 | Greaney | C10G 67/08 208/254 R |

OTHER PUBLICATIONS

Almarri, et al., "Selective Absorption for Removal of Nitrogen Compounds From Liquid Hydrocarbon Streams Over Carbon- and Alumina-Based Absorbents," Industrial and Engineering Chemistry Research, v 48, n 2, p. 951-960, Jan. 21, 2009.

Jean, et al., "The Selective Removal of Nitrogenous-Type Compounds From Fuels by Using Zeolites," Separation Science and Technology, v 20, n 7-8, p. 555-564, Sep.-Oct. 1985.

* cited by examiner

METHODS AND APPARATUSES FOR PROCESSING HYDROCARBON STREAMS CONTAINING ORGANIC NITROGEN SPECIES

TECHNICAL FIELD

The technical field generally relates to methods and apparatuses for processing hydrocarbon streams containing organic nitrogen species, and more particularly relates to methods and apparatuses for removing organic nitrogen species from hydrocarbon streams.

BACKGROUND

When extracted, crude oil may contain a number of undesired compounds or contaminants, such as sulfur compounds. Reduction in the amount of sulfur compounds in automotive fuels and other refined hydrocarbons is typically required in order to meet environmental concerns and governmental regulations. Further, sulfur compounds often adversely impact refinery operations, e.g., by poisoning catalysts. In many hydrocarbon processing schemes, sulfur is removed from the hydrocarbon feedstock by catalytic hydrodesulfurization in hydrotreating process units.

Crude oils also may contain various organic nitrogen species in quantities that impact the refinery processing of the crude oils fractions. Specifically, the presence of organic nitrogen species in the hydrocarbon feedstock may suppress the hydrodesulfurization function of hydrotreating catalysts and require relatively higher operating pressure. This suppression is particularly troublesome for older hydrotreating process units that have relatively lower limits on operating pressure. As a result, older hydrotreating process units cannot process hydrocarbon streams having relatively high organic nitrogen species content, such as cracked feedstocks.

Hydrodesulfurization suppression is also problematic for selective hydrotreating processes that are inherently constrained by low operating pressure. For example, processes for forming high octane product streams require relative lower operating pressures during hydrotreating. Therefore, hydrocarbon streams with a relatively high organic nitrogen species content cannot be processed into high octane products without a reduction in organic nitrogen species content.

Accordingly, it is desirable to provide methods and apparatuses for processing hydrocarbon streams containing organic nitrogen species. Further, it is desirable to provide methods and apparatuses that continuously contact hydrocarbon streams with aqueous acidic solutions to react with and remove organic nitrogen species from the hydrocarbon streams. Furthermore, other desirable features and characteristics will become apparent from the subsequent detailed description and the appended claims, taken in conjunction with the accompanying drawings and the foregoing technical field and background.

BRIEF SUMMARY

Methods and apparatuses for processing hydrocarbon streams containing organic nitrogen species are provided. In one exemplary embodiment, a method for processing a hydrocarbon stream containing organic nitrogen species includes adding an aqueous acidic solution to a hydrocarbon feed stream to form a reaction stream. The method further includes contacting the reaction stream with a reaction surface and reacting the aqueous acidic solution and the organic nitrogen species to form an ammonium sulfate rich stream and a lean nitrogen naphtha stream. Also, the method includes separating an ammonium sulfate rich aqueous phase and an oil phase from the ammonium sulfate rich stream.

In another embodiment, method for processing a hydrocarbon stream including organic nitrogen species includes feeding the hydrocarbon stream to a mixer vessel and continuously injecting an aqueous acidic solution into the mixer vessel. The method further includes mixing the hydrocarbon stream and the aqueous acidic solution to form a reaction stream. The organic nitrogen species and the aqueous acidic solution are reacted in a chamber to form aqueous ammonium sulfates. The method includes withdrawing a lean nitrogen naphtha stream from the chamber.

In another embodiment, an apparatus for processing a hydrocarbon stream containing organic nitrogen species is provided. The apparatus includes a mixer vessel configured to receive and mix the hydrocarbon stream and an aqueous acidic solution to form a reaction stream. Further, the apparatus includes a chamber configured to receive the reaction stream and containing a reactive surface configured to contact the reaction stream and to facilitate a reaction between the organic nitrogen species and the aqueous acidic solution to form an ammonium sulfate rich stream and a lean nitrogen naphtha stream. The apparatus also includes a separation unit configured to separate an ammonium sulfate rich aqueous phase and an oil phase from the ammonium sulfate rich stream.

BRIEF DESCRIPTION OF THE DRAWINGS

Embodiments of methods and apparatuses for processing hydrocarbon streams containing organic nitrogen species will hereinafter be described in conjunction with the following drawing figures, wherein like numerals denote like elements, and wherein.

DETAILED DESCRIPTION OF DRAWINGS

The following detailed description is merely exemplary in nature and is not intended to limit the methods and apparatuses for processing hydrocarbon streams containing organic nitrogen species. Furthermore, there is no intention to be bound by any theory presented in the preceding background or the following detailed description.

Methods and apparatuses for processing hydrocarbon streams containing organic nitrogen species are provided herein. The methods and apparatuses provide for reacting the organic nitrogen species with an aqueous acidic solution. In an exemplary embodiment, an aqueous acidic solution is continuously injected and mixed into a hydrocarbon feed stream. Reaction between the aqueous acidic solution and the organic nitrogen species in the hydrocarbon stream results in the formation of aqueous ammonium sulfates. The reaction rate between the aqueous acidic solution and the organic nitrogen species may be enhanced by contacting the hydrocarbon stream with a reactive surface. The reaction forming the aqueous ammonium sulfates results in a nitrogen lean hydrocarbon stream that may undergo further processing, such as hydrotreating to reduce sulfur content. The aqueous ammonium sulfates may be separated for use as a solid byproduct. Further, exemplary methods and apparatuses provide for control of the flow rates of the hydrocarbon feed stream, the aqueous acidic solution, and the nitrogen lean hydrocarbon stream to maintain continuous injection of the aqueous acidic solution and a minimum level of acidity in the stream during reaction.

Figure 1:
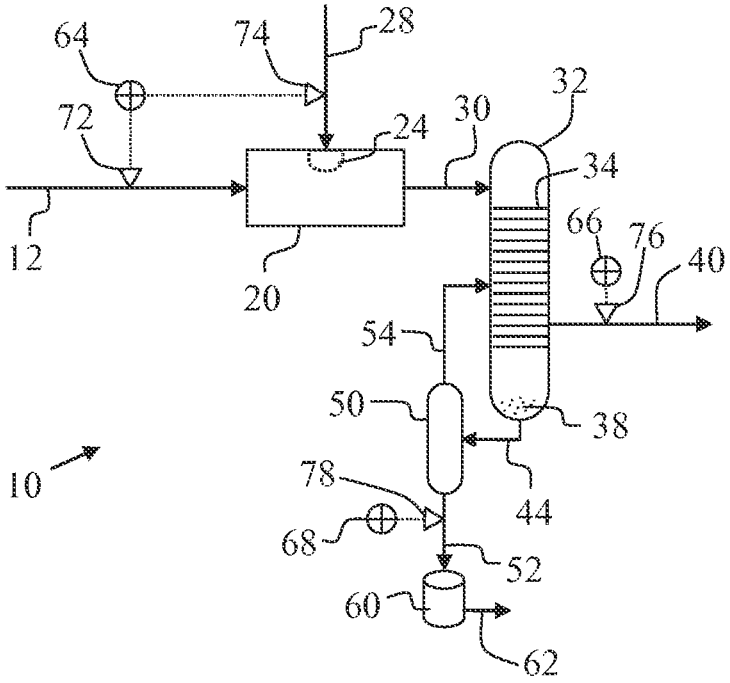
FIG. 1 is a schematic diagram of an embodiment of a method and an apparatus for processing a hydrocarbon stream containing organic nitrogen species in accordance with an embodiment.
Figure 2:
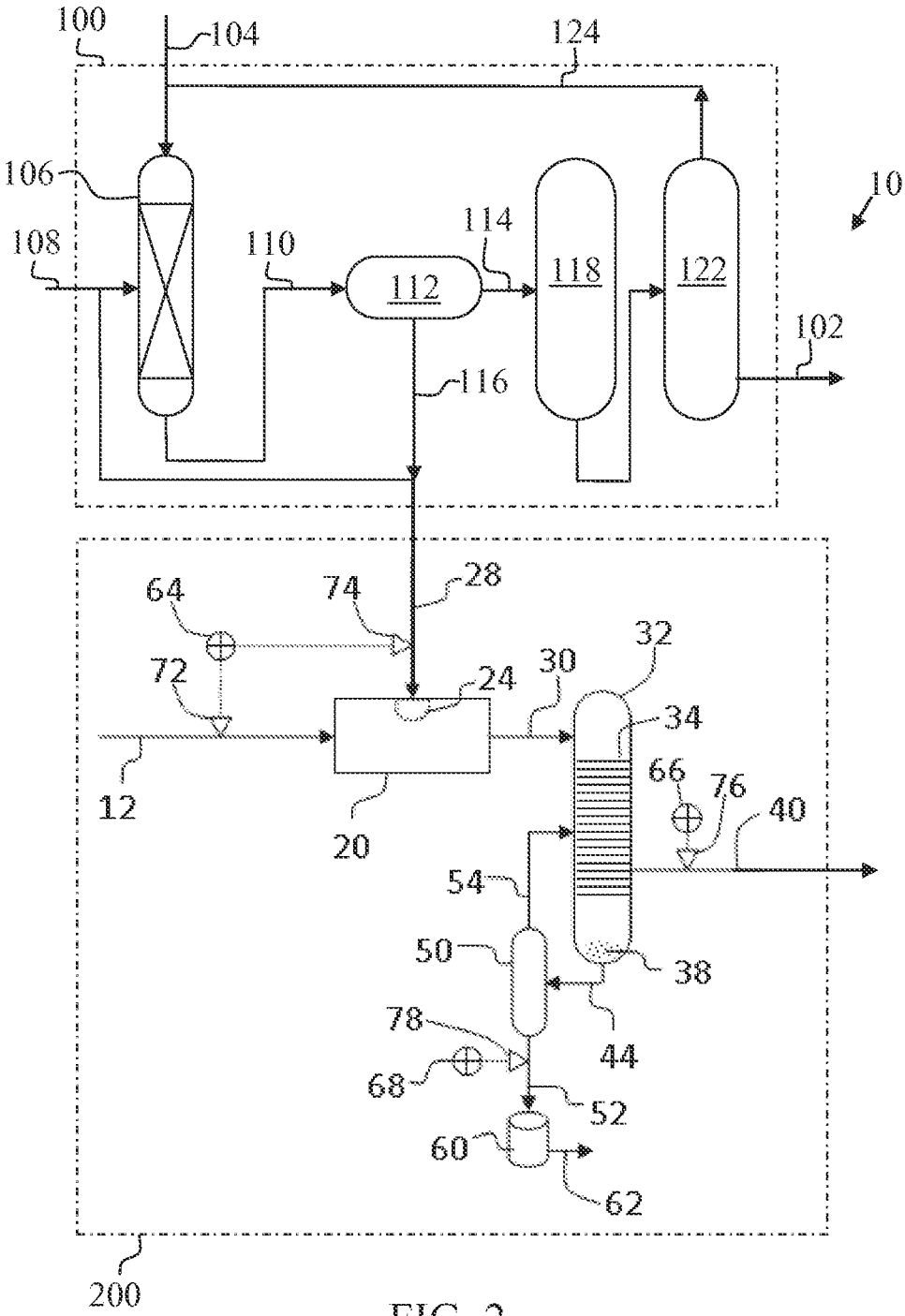
FIG. 2 is a schematic diagram of an embodiment of a method and an apparatus for processing a hydrocarbon stream containing organic nitrogen species including an upstream processing unit in accordance with an embodiment.
Figure 3:
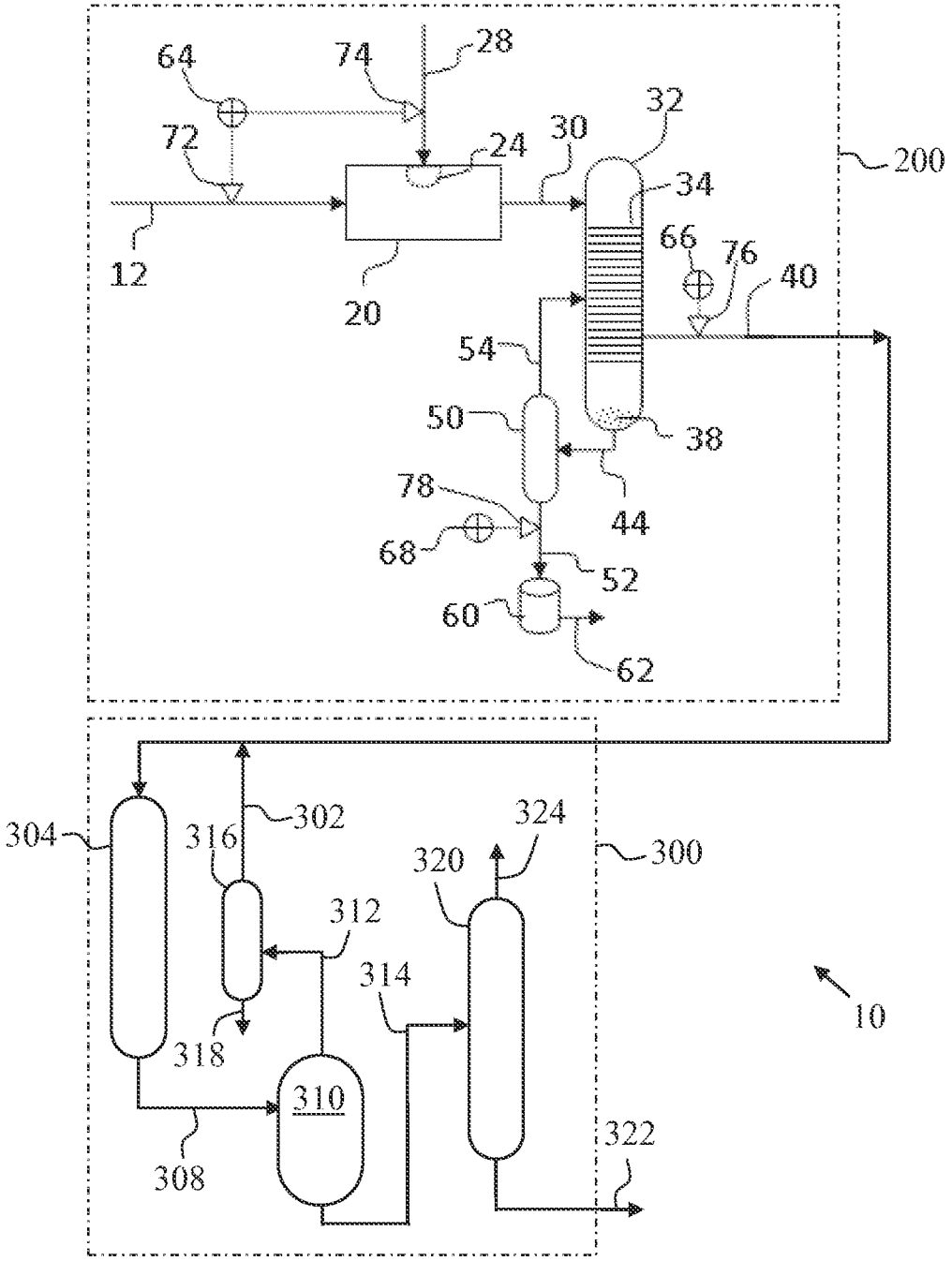
FIG. 3 is a schematic diagram of an embodiment of a method and an apparatus for processing a hydrocarbon stream containing organic nitrogen species including a downstream processing unit in accordance with an embodiment.

Each of FIGS. 1-3 is a simplified process flow diagram illustrating embodiments of a method and apparatus for processing hydrocarbon streams containing organic nitrogen species. Further, each process flow diagram has been simplified in that it may not show the many pieces of mechanical apparatus normally found on such a process including pumps, pressure, temperature and flow rate monitoring and control systems, vessel internals, etc.

FIG. 1 illustrates an exemplary apparatus 10 for processing a hydrocarbon stream 12 containing organic nitrogen species. The exemplary apparatus 10 includes a mixer vessel 20 that receives the hydrocarbon stream 12. An exemplary hydrocarbon stream 12 is a raw naphtha feedstock such as one formed from petroleum crude oil, coal tar, shale deposits, or tar sands. The hydrocarbon stream 12 may be straight run, cracked, or a blend of the two. As shown, the mixer vessel 20 further includes an inlet 24, such as an atomizing nozzle, that injects an aqueous acidic solution 28 into the hydrocarbon stream 12. In an exemplary embodiment, the aqueous acidic solution 28 is formed with a strong acid and has a pH of less than 3, such as less than 2. An exemplary aqueous acidic solution 28 is a solution of at least about 10% sulfuric acid, such as a solution of at least about 20% sulfuric acid. The mixer vessel 20 is configured to mix the hydrocarbon stream 12 and the aqueous acidic solution 28 to form a treated stream 30 having a uniform distribution of each component 12 and 28.

As shown, the treated stream 30 exits the mixer vessel 20 and enters a reaction chamber 32. The exemplary reaction chamber 30 includes a reactive material 34. The reactive material 34 may have small, low-volume pores that provide an increased surface area of the reactive material 34. For example, the reactive material 34 may be a bed of activated carbon or other suitable material providing an increased surface area. Contact of the treated solution 30 with the reactive material 34 increases the rate of reaction between the organic nitrogen species from the hydrocarbon stream 12 and the acid from the aqueous acidic solution 28. During the reaction, sulfuric acid combines with organic nitrogen species to produce ammonium sulfates. As a result, coalesced ammonium sulfates 38 accumulate at the bottom of the reaction chamber 32.

Due to removal of coalesced ammonium sulfates 38 from the treated stream 30, a lean nitrogen hydrocarbon stream 40, i.e., a stream having a lower organic nitrogen content than the hydrocarbon stream 12, is formed and is removed from the reaction chamber 32. In an exemplary embodiment, the organic nitrogen content of the lean nitrogen hydrocarbon stream 40 is less than 30% of the organic nitrogen content of the hydrocarbon stream 12, such as less than 15% of the organic nitrogen content of the hydrocarbon stream 12, for example less than 5% of the organic nitrogen content of the hydrocarbon stream 12. In certain embodiments, the lean nitrogen hydrocarbon stream 40 may be substantially free of organic nitrogen species, such has having fewer than 10 parts per million (ppm). In FIG. 1, the lean nitrogen hydrocarbon stream 40 is removed at a location adjacent the reactive material 34.

After settling, the coalesced ammonium sulfates may be rejected from the reaction chamber 32 in an aqueous phase. Specifically, a bottom stream 44 is removed from the reaction chamber 32 and includes the aqueous phase of dissolved ammonium sulfates and an oil phase. The bottom stream 44 is delivered to a separation unit 50. An exemplary separation unit 50 is a drain pot. As shown, an aqueous ammonium sulfate stream 52 and a recycle oil stream 54 are separated in and removed from the separation unit 50. The recycle oil stream 54 is fed back into the reaction chamber 32. The aqueous ammonium sulfate stream 52 may be processed further at unit 60 to form a solid ammonium sulfate byproduct 62.

As shown in FIG. 1, the apparatus 10 further includes a control system for maintaining a continuous injection of aqueous acidic solution 28 and a selected minimum level of acidity in the reaction chamber 32. Specifically, the control system includes a flow controller 64, a pressure controller 66, and a level controller 68. The flow controller 64 (which may include two separate controllers) is in communication with a valve 72 on the hydrocarbon stream 12 and a valve 74 on the aqueous acidic solution stream 28. The flow controller 66 is in communication with a valve 76 on the lean nitrogen hydrocarbon stream 40. The level controller 68 is in communication with a valve 78 on the aqueous ammonium sulfate stream 52. During operation, the hydrocarbon feed 12 and aqueous acidic solution 28 enter the mixer vessel 20 on flow control, the lean nitrogen hydrocarbon stream 40 exits the reaction chamber 32 on pressure control, and the aqueous ammonium sulfate stream 52 exits the separation unit 50 on level control. The controllers 64 and 66 selectively open valves 72, 74, and 76 to maintain or adjust a desired acidity in the reaction chamber 32.

Referring to FIG. 2, an apparatus 10 for processing a hydrocarbon stream 12 includes an upstream processing zone 100 for providing the aqueous acidic solution 28. In the exemplary embodiment, the processing zone 100 is a sulfuric acid alkylation process unit. An exemplary sulfuric acid alkylation process combines low-molecular-weight olefins with isobutene in the presence of sulfuric acid as a catalyst. An alkylate product 102 is formed and is composed of a mixture of high-octane, branched-chain paraffinic hydrocarbons. In FIG. 2, a hydrocarbon feedstock 104, such as a stream of propylene, butylene, amylene, and isobutane, is received by a reactor 106. Also, a stream of sulfuric acid 108 is fed into the reactor 106. The hydrocarbon feedstock 104 contacts the sulfuric acid catalyst 108 and reacts within the reactor 106.

A reactor effluent 110 is formed and is fed to an acid settler 112. The reactor effluent 110 is separated into hydrocarbon phase 114 and an acid phase 116 in the acid settler 112. The hydrocarbon phase 114 is delivered to a caustic scrubber 118 where it is hot-water washed with caustic for pH control. It is then delivered to a deisobutanizer 122 and is successively depropanized, deisobutanized, and debutanized. The alkylate product 102 obtained from the deisobutanizer 112 can then go directly to motor-fuel blending or be rerun to produce aviation-grade blending stock. The isobutane 124 is recycled to the feed.

As shown, a portion of the acid phase 116, containing aqueous sulfuric acid, may be recycled for re-introduction to the reactor 106. Alternatively or additionally, the acid phase 116 may be utilized in the nitrogen removal zone 200 as aqueous acidic solution 28. As a result of the nitrogen removal process utilizing the aqueous acidic solution 28 outlined in reference to FIG. 1, a lean nitrogen hydrocarbon stream 40 is produced and exits the nitrogen removal zone 200.

In FIG. 3, the exemplary apparatus 10 for processing a hydrocarbon stream 12 includes a downstream processing zone 300 for further processing of the lean nitrogen hydrocarbon stream 40. In the exemplary embodiment, the processing zone 300 is a hydrodesulfurization unit. As shown, the lean nitrogen hydrocarbon stream 40 is introduced to the downstream processing zone 300 and is combined with a hydrogen rich recycle gas 302. The combined stream is heated such that the combined stream is totally vaporized and then is fed into a fixed bed reactor 304 (or a series of fixed bed reactors). The hydrodesulfurization reaction occurs in the fixed bed reactor 304, typically in the presence of a catalyst consisting of an alumina base impregnated with cobalt and molybdenum. The lean nitrogen hydrocarbon stream 40 may contain a wide range of organic sulfur compounds, including thiols, thiophenes, organic sulfides and disulfides, and many others. These organic sulfur compounds are converted by the hydrodesulfurization reaction to hydrogen sulfide.

After hydrodesulfurization occurs in the reactor 304, a reactor effluent 308 including hydrogen sulfide may be cooled through heat exchange with the incoming feed (not shown) and decompressed such that the reactor effluent 308 includes a mixture of liquid and gas. The reactor effluent 308 enters a gas separator vessel 310 which separates the reactor effluent 308 into a gas stream 312 and a liquid stream 314. The gas stream 312 passes through an amine contactor 316 where hydrogen sulfide is removed in stream 318. The hydrogen sulfide free gas then forms recycle gas 302 which is combined with the incoming lean nitrogen hydrocarbon stream 40.

The liquid stream 314 from the gas separator vessel 310 is routed through a stripper distillation tower 320. The bottoms product 322 from the stripper distillation tower 320 forms a desulfurized liquid product. The overhead sour gas 324 formed by the stripper distillation tower 320 typically contains hydrogen, methane, ethane, hydrogen sulfide, propane, and, perhaps, some butane and heavier components. That sour gas may be processed for removal of hydrogen sulfide and for recovery of propane, butane and pentane or heavier components. The residual hydrogen, methane, ethane, and some propane may be used as refinery fuel gas. The hydrogen sulfide removed and recovered by amine gas treating unit may be subsequently converted to elemental sulfur in a Claus process unit or to sulfuric acid in a wet sulfuric acid process or in the conventional Contact Process.

As described herein, a method and apparatus for processing a hydrocarbon stream containing organic nitrogen species have been provided. In exemplary embodiments, an aqueous acidic solution is continuously injected into the hydrocarbon stream and reacted with the organic nitrogen species therein to form ammonium sulfates. The ammonium sulfates are removed from the lean nitrogen hydrocarbon stream as an aqueous stream. The method and apparatus described above are particularly well-suited for use in upstream processing before hydrodesulfurization.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the claimed subject matter in any way. Rather, the foregoing detailed description will provide those skilled in the art with a convenient road map for implementing an exemplary embodiment or embodiments. It being understood that various changes may be made in the function and arrangement of elements described in an exemplary embodiment without departing from the scope set forth in the appended claims.

What is claimed is:

1. A method for processing a hydrocarbon stream containing organic nitrogen species, the method comprising the steps of:

adding an aqueous acidic solution to a hydrocarbon feed stream to form a reaction stream;

contacting the reaction stream with a reaction surface comprising a reactive material to provide increased surface area and reacting the aqueous acidic solution and the organic nitrogen species to form an ammonium sulfate rich stream and a lean nitrogen naphtha stream, wherein contacting the reaction stream with a reaction surface comprises passing the reaction stream through a bed of activated carbon; and separating an ammonium sulfate rich aqueous phase and an oil phase from the ammonium sulfate rich stream.

2. The method of claim 1 further comprising the step of recycling the oil phase to the reaction surface.

3. The method of claim 1 wherein adding an aqueous acidic solution to a hydrocarbon feed stream to form a reaction stream comprises:

feeding the hydrocarbon feed stream to a mixer vessel;

injecting the aqueous acidic solution into the mixer vessel; and mixing the reaction stream in the mixer vessel.

4. The method of claim 1 wherein adding an aqueous acidic solution to a hydrocarbon feed stream comprises injecting the aqueous acidic solution through an atomizer to uniformly distribute the aqueous acidic solution.

5. The method of claim 1 wherein adding an aqueous acidic solution to a hydrocarbon feed stream comprises adding a solution of at least about 10 wt % sulfuric acid.

6. The method of claim 1 wherein adding an aqueous acidic solution to a hydrocarbon feed stream comprises adding a solution of at least about 20 wt % sulfuric acid.

7. The method of claim 1 further comprising the step of removing the aqueous acidic solution from a sulfuric acid alkylation process unit before adding to the hydrocarbon feed stream.

8. The method of claim 1 further comprising the step of hydrotreating the lean nitrogen naphtha stream.

9. A method for processing a hydrocarbon stream including organic nitrogen species, the method comprising the steps of:

feeding the hydrocarbon stream to a mixer vessel;

continuously injecting an aqueous acidic solution into the mixer vessel;

mixing the hydrocarbon stream and the aqueous acidic solution to form a reaction stream;

contacting the reaction stream with a reaction surface comprising a reactive material to provide increased surface area, wherein contacting the reaction stream with a reaction surface comprises passing the reaction stream through a bed of activated carbon;

reacting the organic nitrogen species and the aqueous acidic solution in a chamber to form aqueous ammonium sulfates; and withdrawing a lean nitrogen naphtha stream from the chamber.

10. The method of claim 9 wherein:

feeding the hydrocarbon stream to a mixer vessel comprises feeding the hydrocarbon stream to a mixer vessel at a first rate;

continuously injecting an aqueous acidic solution into the mixer vessel comprises continuously injecting an aqueous acidic solution into the mixer vessel at a second rate; and withdrawing a lean nitrogen naphtha stream from the chamber comprises withdrawing a lean nitrogen naphtha stream from the chamber at a third rate.

11. The method of claim 10 further comprising the steps of:

controlling the first rate and the second rate with a flow control system; and controlling the third rate with a pressure control system.

12. The method of claim 9 further comprising the steps of:

feeding an ammonium sulfate rich stream including the aqueous ammonium sulfates to a separation unit; and separating an ammonium sulfate rich aqueous phase and an oil phase from the ammonium sulfate rich stream.

13. The method of claim 12 further comprising the step of removing the ammonium sulfate rich aqueous phase from the separation unit.

14. The method of claim 9 wherein:

feeding the hydrocarbon stream to a mixer vessel comprises feeding the hydrocarbon stream to a mixer vessel at a first rate;

continuously injecting an aqueous acidic solution into the mixer vessel comprises continuously injecting an aqueous acidic solution into the mixer vessel at a second rate;

withdrawing a lean nitrogen naphtha stream from the chamber comprises withdrawing a lean nitrogen naphtha stream from the chamber at a third rate; and the method further comprises the steps of:

feeding an ammonium sulfate rich stream including the aqueous ammonium sulfates to a separation unit;

separating an ammonium sulfate rich aqueous phase and an oil phase from the ammonium sulfate rich stream;

removing the ammonium sulfate rich aqueous phase from the separation unit at a fourth rate;

controlling the first rate and the second rate with a flow control system;

controlling the third rate with a pressure control system; and controlling the fourth rate with a level control system.

15. The method of claim 9 wherein continuously injecting an aqueous acidic solution into the mixer vessel comprises injecting a solution of at least about 10 wt % sulfuric acid through an atomizer into the mixer vessel.

16. The method of claim 9 further comprising the step of removing the aqueous acidic solution from a sulfuric acid alkylation process unit before continuously injecting the aqueous acidic solution into the mixer vessel.

17. The method of claim 9 further comprising the step of hydrotreating the lean nitrogen naphtha stream.

* * * * *